US012385206B2

(12) United States Patent
Jenewein

(10) Patent No.: US 12,385,206 B2
(45) Date of Patent: Aug. 12, 2025

(54) APPARATUS FOR ENDING A TUBULAR PILE FOUNDATION

(71) Applicant: Tiroler Rohre GmbH, Hall in Tirol (AT)

(72) Inventor: Erwin Jenewein, Kolsassberg (AT)

(73) Assignee: TIROLER ROHRE GMBH, Hall In Tirol (AT)

( * ) Notice: Subject to any disclaimer, the term of this patent is extended or adjusted under 35 U.S.C. 154(b) by 153 days.

(21) Appl. No.: 18/121,894

(22) Filed: Mar. 15, 2023

(65) Prior Publication Data

US 2023/0313482 A1 Oct. 5, 2023

(30) Foreign Application Priority Data

Mar. 30, 2022 (AT) ..... A 50205/2022

(51) Int. Cl.
*E02D 5/22* (2006.01)
*E02D 27/12* (2006.01)

(52) U.S. Cl.
CPC ..... *E02D 5/223* (2013.01); *E02D 27/12* (2013.01); *E02D 2300/0031* (2013.01)

(58) Field of Classification Search
CPC ..... E02D 5/223; E02D 27/12; E02D 5/226; E02D 5/60
See application file for complete search history.

(56) References Cited

U.S. PATENT DOCUMENTS

| | | | |
|---|---|---|---|
| 10,895,053 | B2 | 1/2021 | Suarez et al. |
| 2016/0122966 | A1 | 5/2016 | Brugger |
| 2019/0338485 | A1 | 11/2019 | Arena et al. |
| 2021/0214909 | A1 | 7/2021 | Nakamura et al. |

FOREIGN PATENT DOCUMENTS

| | | | |
|---|---|---|---|
| AT | 516480 | | 5/2016 |
| CN | 212835352 | | 3/2021 |
| CN | 114753350 | | 7/2022 |
| GB | 2 424 024 | | 9/2006 |
| GB | 2555065 | * | 4/2018 |
| GB | 2561310 | | 10/2018 |
| JP | 2019-214897 | | 12/2019 |
| JP | 2020037780 | * | 3/2020 |
| KR | 2001-0057749 | | 7/2001 |
| KR | 10-1021466 | | 3/2011 |
| KR | 10-2151726 | | 9/2020 |
| NZ | 563725 | | 4/2009 |

OTHER PUBLICATIONS https://www.thefreedictionary.com/on; Feb. 18, 2025.*

* cited by examiner

*Primary Examiner* — Sean D Andrish

(74) *Attorney, Agent, or Firm* — Wenderoth, Lind & Ponack, L.L.P.

(57) ABSTRACT

An apparatus for ending a tubular pile foundation includes a substantially plate-shaped pressure distribution plate which comprises a substantially flat plate surface and a contact surface opposite the plate surface for a structure to be erected on the tubular pile foundation. The pressure distribution plate can be fitted with the plate surface onto a pile end of a tubular pile of the tubular pile foundation. At least one centering collar for centering the apparatus on the pile end is arranged on the plate surface, and at least one support structure for reinforcing the pressure distribution plate is arranged on the contact surface.

27 Claims, 9 Drawing Sheets

APPARATUS FOR ENDING A TUBULAR PILE FOUNDATION

BACKGROUND OF THE INVENTION

The invention relates to an apparatus for ending a tubular pile foundation, in particular a pile head plate. The apparatus comprises a substantially plate-shaped pressure distribution plate which can be fitted with a substantially flat plate surface onto a pile end of a tubular pile of the tubular pile foundation.

Tubular pile foundations, also referred to as pile foundations, are a type of deep foundation used in the construction industry. The individual tubular piles—also referred to as driven piles—which, for the most part, consist of ductile cast iron and have predetermined lengths of, for example, five meters, are fitted into one another in order to produce a pile foundation. In order to make it easier to fit driven piles into one another and, consequently, to increase the length of a pile foundation, the driven piles usually have a conically tapering first pile end and a second pile end formed in the manner of a socket. As a result, the foundation can be driven pile by pile into the ground, making it possible to produce pile foundations of any length quickly and cost-effectively. Driven piles of this type are usually produced in a centrifugal casting process with a shaping rotating mold. In the process, substantially cylindrical tubular piles are formed, which are hollow inside. Depending on the mode of use, these hollow-cylindrical driven piles can be filled or sheathed with concrete or another suitable injection material to produce a stable foundation after having been driven into the ground.

So-called pile head plates are frequently fitted at the upper end of tubular pile foundations onto the pile ends of the last tubular piles of the tubular pile foundation. The structures erected on the tubular pile foundation are mounted on these pile head plates. Conventional pile head plates are usually made of steel and have a bore with a diameter of approximately 30 mm in the center of the plate, through which bore concrete or concrete emulsion can be introduced, in the case of tubular pile foundations having pressed piles, and the use of a threaded rod as reinforcement for the concrete inside the pile is made possible. Known pile head plates made of steel have a plate thickness of approximately 35 to 40 mm.

Pile head plates, which have support ribs on the plate surface of the pressure distribution plate facing the pile end for reinforcement, are also known. As a result, the pressure distribution plates can be realized with significantly smaller plate thicknesses.

Furthermore, pile head plates which, in addition to support ribs, also have circular centering collars on the plate surface facing the pile end, in order to facilitate a centered fitting of the pile head plate onto a pile end, are known from AT 516480 A1.

The disadvantage of the known pile head plates with support ribs arranged on the plate surface facing the pile end is that the support ribs can be a hindrance when the pile head plate is fitted onto the pile end. If, for example, a pile head plate is not fitted quite centrally onto the pile end, this can lead to a region of the pile end being in contact with a support rib and, as a result, the pile head plate does not rest in a planar manner on the pile end, but rather in a tilted position. Such a misalignment of the pile head plate can cause consequential errors in the erection of the tubular pile foundation.

SUMMARY OF THE INVENTION

The object of the invention is to specify an apparatus for ending a tubular pile foundation, which is improved with respect to the state of the art, in particular a pile head plate. In particular, the aim is to achieve a simplified handling at the same time as retaining or even improving the stability of the apparatus.

According to the invention, at least one support structure for reinforcing the pressure distribution plate is arranged on the contact surface.

That is to say that, in this case, as distinct from the known pile head plates, a support structure strengthening the stability of the pile head plate is not arranged on the plate surface facing the pile end, on which the at least one centering collar for centering the pile head plate on the pile end is also arranged. In contrast thereto, such a support structure is arranged on the contact surface facing away from the pile end, on which contact surface a structure to be erected on the tubular pile foundation is to be arranged or is mounted. As a result, on the one hand, the support structure does not cause any interference when the pile head plate is fitted onto the pile end. Since the support structure is not arranged on the plate surface facing the pile end, the positioning of the pile head plate on the pile end is facilitated, so that the handling of the pile head plate is improved. On the other hand, the arrangement of the support structure on the contact surface facing away from the pile end means that the support structure can be configured more freely since, in terms of the support structure, there is no need to make allowances for a region which has to remain free, in any case, around the pile end. This makes it possible to configure the support structure as desired, as a result of which an improved stability of the pile head plate can also be attained, compared with the conventional pile head plates. Furthermore, the support structure facing a structure to be arranged on the pile head plate results in an improvement of the connection of the pile head plate to the structure to be erected on the plate by guaranteeing that the pile head plate is integrated into the foundation in a non-positive manner in all 4 horizontal directions.

Preferably, the pressure distribution plate has a polygonal, preferably octagonal, outer contour. As a result of the tubular piles of a tubular pile foundation being, for the most part, formed as tubular hollow bodies, a polygonal outer contour of the pressure distribution plate makes it possible to cover the pile end uniformly and horizontally direction-independently.

According to a preferred embodiment, the support structure comprises a substantially plate-shaped support block, preferably arranged centrally on the contact surface. The support block has a smaller areal extent than the pressure distribution plate itself and is preferably arranged centrally on the pressure distribution plate so that it confers increased stability on the pressure distribution plate in the central region.

In a further embodiment, the support structure comprises at least one support rib, wherein the at least one support rib is preferably formed as a substantially bar-shaped wall. The bar-shaped wall can have a wall thickness of at least 10 mm, up to preferably approximately 19 mm, and the outer edges of the wall can be formed rounded.

The provision of support ribs means that the stability of the pressure distribution plate can be improved along the support ribs. In particular, support ribs support the pressure distribution plate when receiving a load of a concrete foundation or structure, which is being mounted on the apparatus. The at least one support rib can preferably be formed integral with the pressure distribution plate.

According to a preferred embodiment, a height of the at least one support rib increases, preferably substantially linearly, in relation to the contact surface along the longitudinal extent of the support rib starting from an outer edge of the contact surface. The height of the at least one support rib increases along a straight line inclined in relation to the contact surface, wherein the straight line has an angle of inclination of approximately 15° to 30°, preferably approximately 15° to 25°, in relation to the contact surface.

According to a particularly preferred embodiment, the at least one support rib is arranged on the support block or adjoins the support block, wherein the at least one support rib is preferably formed integral with the support block. The joining of support ribs to the support block can result in an optimized application of force via the support ribs into the support block.

In particular, in the case of a pressure distribution plate having a polygonal outer contour, starting from each corner of the outer contour, a support rib runs to the support block. In the case of an octagonal outer contour of the pressure distribution plate, for example, the support ribs run substantially at right angles to an edge connecting two corners in the direction of the support block in the region of the corners of the outer contour. When the support ribs are arranged in such a manner, this produces a cross-shaped support structure having the support block in the center.

In general, the entire support structure is formed integral with the pressure distribution plate. The integral nature of the support structure with the pressure distribution plate leads to a particularly effective reinforcement of the pressure distribution plate. The integral nature can be attained, for example, by producing the pressure distribution plate from, preferably ductile, cast iron by means of casting processes.

Preferably, the at least one centering collar comprises at least one collar section in the form of a circular arc. This facilitates the centering of the apparatus on the pile end since, as a result, the at least one centering collar can be fitted particularly easily onto a tubular pile end having a cross section in the form of a circular ring. The at least one centering collar is preferably formed as a bar running along a circular path. The bar can, for example, have a wall thickness of approximately 5 mm to approximately 12 mm, preferably approximately 8 mm to 10 mm, and the outer edges of the bar can be formed rounded.

Particularly preferably, the at least one centering collar comprises multiple, preferably two to four, collar sections in the form of circular arcs, wherein the collar sections in the form of circular arcs are preferably uniformly distributed along a common circular path. In other words, the at least one centering collar has interruptions along the circular path. These interruptions prevent air inclusions under the pressure distribution plate, in the case of piles pressed with concrete, since air which is also introduced during the introduction of concrete can escape laterally in the region of the interruptions.

In a preferred embodiment, the at least one, preferably each, collar section in the form of a circular arc has a stop region along a section longitudinal extent, wherein the stop region preferably has a substantially constant stop height.

Preferably, the at least one collar section in the form of a circular arc has a section height reduced with respect to the stop height along the section longitudinal extent in the region of its section ends. In other words, the collar sections have, in this case, a reduced height at the ends thereof. This height reduction can be formed in steps or running continuously. The height reduction can be advantageous if it is desired that multiple apparatuses be stacked on top of one another (e.g. for transporting purposes or in order to store them in a space-saving manner).

Thus, preferably the at least one collar section in the form of a circular arc is arranged opposite the support structure arranged on the contact surface. In this case, the height reduction can, for example, correspond to the formation of the support structure on the contact surface of the lower apparatus so that a space-saving and stable stacking of multiple apparatuses on top of one another is made possible.

Preferably, the at least one centering collar is formed integral with the pressure distribution plate.

According to a particularly preferred embodiment, it can be provided that the pressure distribution plate consists, at least partially, preferably substantially completely, of cast iron. The fact that the pressure distribution plate is produced by a casting process from preferably ductile cast iron means that it can in particular be provided that the support structure and/or the at least one centering collar is/are formed integral with the pressure distribution plate.

In a preferred embodiment, the pressure distribution plate has a plate thickness of at most 35 mm, preferably approximately 20 mm to 30 mm.

According to a further preferred embodiment, the apparatus has at least one through hole, wherein the at least one through hole preferably has a diameter of larger than 50 mm, particularly preferably larger than 70 mm. As a result, the operation of filling piles with concrete or concrete emulsion can be facilitated in the case of pressed piles.

The at least one through hole is preferably arranged centrally. The at least one through hole extends through the pressure distribution plate and the support structure (if, e.g., the support structure comprises a support block, the through hole extends also through the support block).

Preferably, the at least one through hole is formed conically tapering in the direction of the plate surface, wherein a wall angle of an inside wall of the at least one through hole to the plate surface is preferably approximately 91° to approximately 110°, particularly preferably approximately 98°.

According to a particularly preferred embodiment, an anti-tilt device protruding from the plate surface is arranged on the apparatus. The anti-tilt device prevents too large a decentering of the apparatus in relation to a pile end, onto which the apparatus is fitted. In particular, this prevents the pile head plate from falling down due to too large decentering on the pile end or, in relation to the further piles positioned on a construction site, from being placed too far out of alignment with respect to the further piles, but nevertheless allows a certain clearance for adjusting the alignment with the other piles.

In the event that at least one through hole is present, the anti-tilt device is partially arranged in the at least one through hole.

Preferably, the anti-tilt device has a substantially plate-shaped central plate and at least one anti-tilt protrusion projecting, preferably substantially perpendicularly, from a first central plate surface of the central plate, wherein the at least one anti-tilt protrusion preferably has a protrusion end angled in the direction of the first central plate surface (i.e., angled toward a central longitudinal axis of the anti-tilt device). The angling facilitates the fitting of the anti-tilt device onto a pile end and can be, for example, approximately 5° to approximately 20°, preferably approximately 15°.

In a preferred embodiment, the anti-tilt device comprises multiple, preferably two to four, anti-tilt protrusions, wherein the anti-tilt protrusions are preferably uniformly distributed along a central plate outer contour of the central plate.

Preferably, the at least one anti-tilt protrusion is arranged resiliently in the manner of a spring on the central plate. In this way, the at least one anti-tilt protrusion can, for example, be formed integral with the central plate and can be manufactured from elastic material, e.g. from a sheet steel. The desired form of the central plate having anti-tilt protrusions protruding therefrom can, for example, be cut out from a sheet steel. The anti-tilt protrusions are then bent up until they are arranged substantially perpendicular to the central plate (this corresponds to a plastic deformation). In this new position, the bent-up anti-tilt protrusions can be elastically deformed within the deformation limits predefined by the material and are therefore arranged in the manner of a spring on the central plate.

According to a particularly preferred embodiment, the anti-tilt device has at least one clamp element projecting from a second central plate surface of the central plate opposite the first central plate surface at a clamp angle of approximately 90° to approximately 110°, preferably approximately 95°, wherein the at least one clamp element preferably has an element end angled in the direction of the second central plate surface. The angling facilitates the insertion of the anti-tilt device into a through hole of the apparatus and can be, for example, approximately 10° to approximately 25°, preferably approximately 20°.

In the event that at least one through hole is present and the through hole is formed conical, preferably the clamp angle corresponds to the wall angle. In this case, for an optimal clamping of the anti-tilt device in the through hole, the clamp angle of the clamp elements which have not been loaded or which have not yet been guided into the through hole should be slightly larger than the wall angle of the through hole, into which the anti-tilt device is to be inserted. As a result, the clamp elements press against the inside wall of the through hole when they are guided into the through hole, and thus guarantee that the anti-tilt device is held stably in the through hole.

Preferably, the anti-tilt device comprises multiple, preferably two to four, clamp elements, wherein the clamp elements are preferably uniformly distributed along a central plate outer contour of the central plate.

Preferably, anti-tilt protrusions and clamp elements are arranged offset with respect to one another along the central plate outer contour, e.g. respectively alternating anti-tilt protrusions and clamp elements.

In a preferred embodiment, the at least one clamp element is arranged resiliently in the manner of a spring on the central plate. In this way, the at least one clamp element can, for example, be formed integral with the central plate and can be manufactured from elastic material, e.g. from a sheet steel. The desired form of the central plate having clamp elements protruding therefrom can, for example, be cut out from a sheet steel. The clamp elements are then bent up until they are arranged substantially perpendicular to the central plate (this corresponds to a plastic deformation). In this new position, the bent-up clamp elements can be elastically deformed within the deformation limits predefined by the material and are therefore arranged in the manner of a spring on the central plate.

Preferably, the at least one clamp element is substantially located completely within the through hole and is in contact with an inside wall of the through hole.

According to a preferred embodiment, the central plate has a, preferably centrally arranged, central opening.

In the event that at least one through hole of the apparatus is present, the central opening preferably aligns, in the assembled state of the anti-tilt device on the apparatus, with the through hole. As a result, the operation of filling piles with concrete or concrete emulsion can be facilitated in the case of pressed piles.

BRIEF DESCRIPTION OF THE DRAWINGS

Further details and advantages of the present invention will be explained with reference to the following description of the figures, in which.

DETAILED DESCRIPTION OF THE INVENTION

Figure 1:
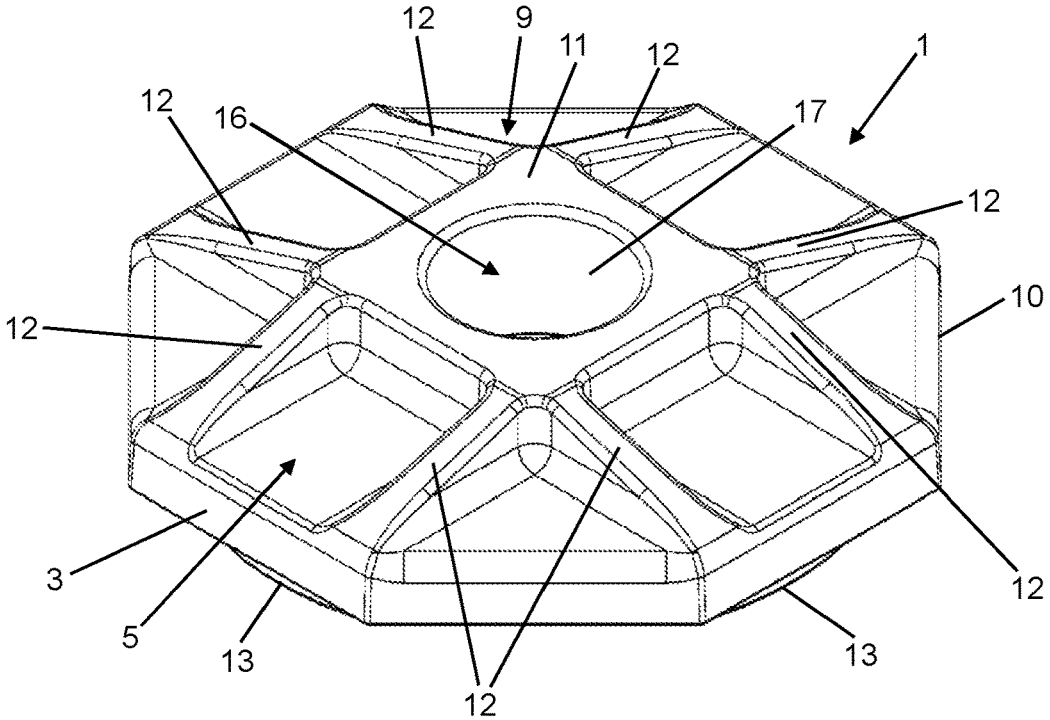
FIG. 1 is a perspective top view of the contact surface of a proposed apparatus for ending a tubular pile foundation.

FIG. 1 shows a perspective top view of the contact surface 5 of a proposed apparatus 1 for ending a tubular pile foundation 2 which is not represented here (see FIGS. 9 to 12 for this).

The apparatus 1 comprises a substantially plate-shaped pressure distribution plate 3 which has a contact surface 5 for a structure to be erected on the tubular pile foundation 2. In order to reinforce the pressure distribution plate 3, a support structure 9 is arranged on the contact surface 5.

The support structure 9 comprises a plate-shaped support block 11 which is arranged centrally on the contact surface 5. The support block 11 is formed integral (particularly as one piece) with the pressure distribution plate 3.

Moreover, the support structure 9 comprises multiple support ribs 12 in the form of bar-shaped walls. The support ribs 12 run, starting from the outer contour 10 of the pressure distribution plate 3, up to the support block 11. The support ribs 12 are formed in such a way that the heights thereof increase substantially linearly in relation to the contact surface 5 along the longitudinal extents of the support ribs 12, starting from the outer contour 10 of the pressure distribution plate 3, up to the height of the support block 11. The support ribs 12 are formed integral (particularly as one piece) with the support block 11 and with the pressure distribution plate 3.

The pressure distribution plate 3 has a polygonal, in the specific example octagonal, outer contour 10. Starting from each of the eight corners of the octagonal outer contour 10, a support rib 12 in each case runs to the support block 11, wherein, in the region of the corners of the outer contour 10, the support ribs 12 run substantially at right angles to an edge of the outer contour 10, which in each case connects two corners, in the direction of the support block 11. In each case, two support ribs 12 run parallel to one another to the support block 11. This arrangement of the support ribs 12 produces a cross-shaped support structure 9 having the support block 11 in the center.

The apparatus 1 shown has a through hole 16. The through hole 16 is arranged centrally and extends through the pressure distribution plate 3 and the support structure 9 arranged on the contact surface 5 of the pressure distribution plate 3. In the example shown, the through hole 16 runs through the centrally arranged support block 11 and through the pressure distribution plate 3. The through hole 16 is formed conically tapering in the direction of the lower plate surface 4 of the pressure distribution plate 3, which is not visible in FIG. 1. The inside wall 17 of the through hole 16, which is formed conically tapering in the direction of the plate surface 4 of the pressure distribution plate 3, is visible.

Figure 2:
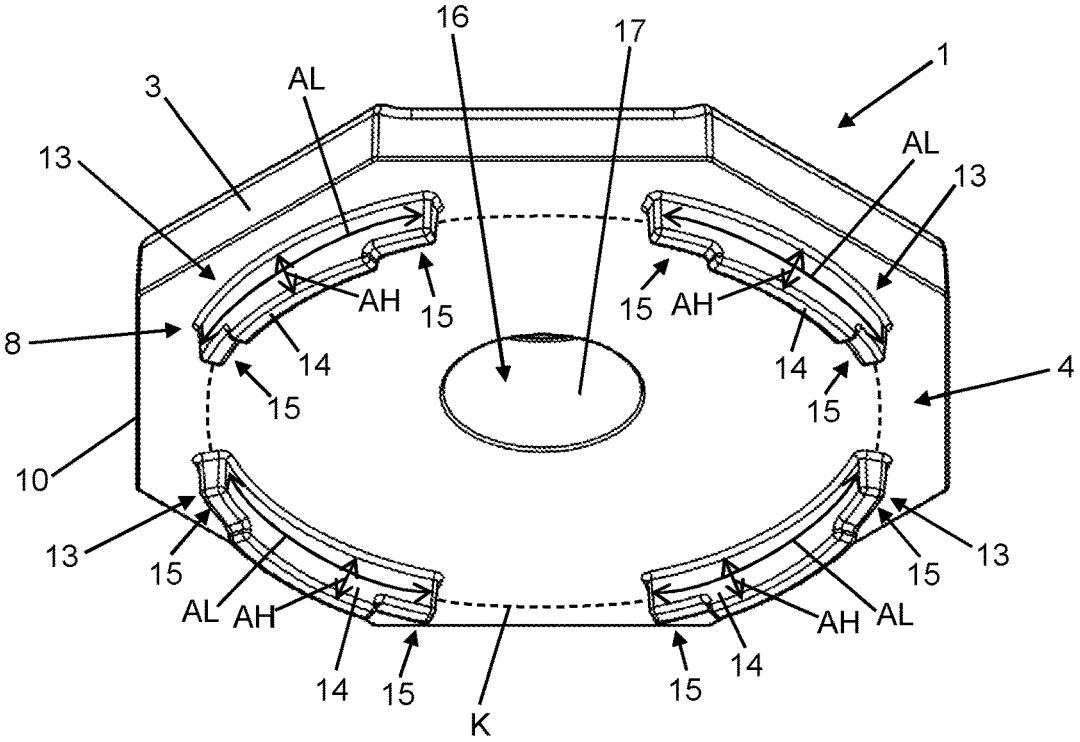
FIG. 2 is a perspective bottom view of the plate surface of the apparatus according to FIG. 1.

FIG. 2 shows a perspective bottom view of the plate surface 4 of the apparatus 1 according to FIG. 1. The pressure distribution plate 3 of the apparatus 1 has a substantially flat plate surface 4 opposite the contact surface 5. The pressure distribution plate 3 can be fitted with the plate surface 4 onto a pile end 6 of a tubular pile 7 of a tubular pile foundation 2 (see FIGS. 9 to 12).

In order to center the apparatus 1 on the pile end 6, a centering collar 8 is arranged on the plate surface 4. The centering collar 8 of the apparatus 1 shown comprises four collar sections 13 in the form of circular arcs, wherein the collar sections 13 in the form of circular arcs are uniformly distributed along a common circular path K. In other words, the centering collar 8 has interruptions or free spaces between the collar sections 13 in the form of circular arcs along the circular path K. These interruptions or free spaces prevent air inclusions under the pressure distribution plate 3, in the case of piles pressed with concrete, since air which is also introduced during the introduction of concrete can escape laterally in the region of the interruptions or free spaces.

Each of the collar sections 13 in the form of circular arcs has a stop region 14 along a section longitudinal extent AL, wherein a respective stop region 14 has a substantially constant stop height AH. A respective collar section 13 in the form of a circular arc has a section height reduced with respect to the stop height AH along the section longitudinal extent AL in the region of its section ends 15.

The collar sections 13 in the form of circular arcs are, in the example shown, arranged opposite the support structure 9 on the contact surface 5, namely in such a way that multiple apparatuses 1 can be conveniently stacked on top of one another. In particular, a collar section 13 in the form of a circular arc can be inserted, in each case, with its stop region 14 having a substantially constant stop height AH between two support ribs 12, i.e. the longitudinal extent of a stop region 14 having a substantially constant stop height AH preferably corresponds to the distance between two support ribs 12 running parallel to one another.

The entire support structure 9 arranged on the contact surface 5 of the pressure distribution plate 3, comprising the support block 11 and the support ribs 12 as well as the collar sections 13 of the centering collar 8 arranged on the plate surface 4 of the pressure distribution plate 3, is formed integral (particularly, in one piece) with the pressure distribution plate 3. The integral nature of the apparatus 1 shown was achieved as a result of the pressure distribution plate 3, together with the support structure 9 and the collar sections 13, being produced by a casting process from ductile cast iron.

Figure 3:
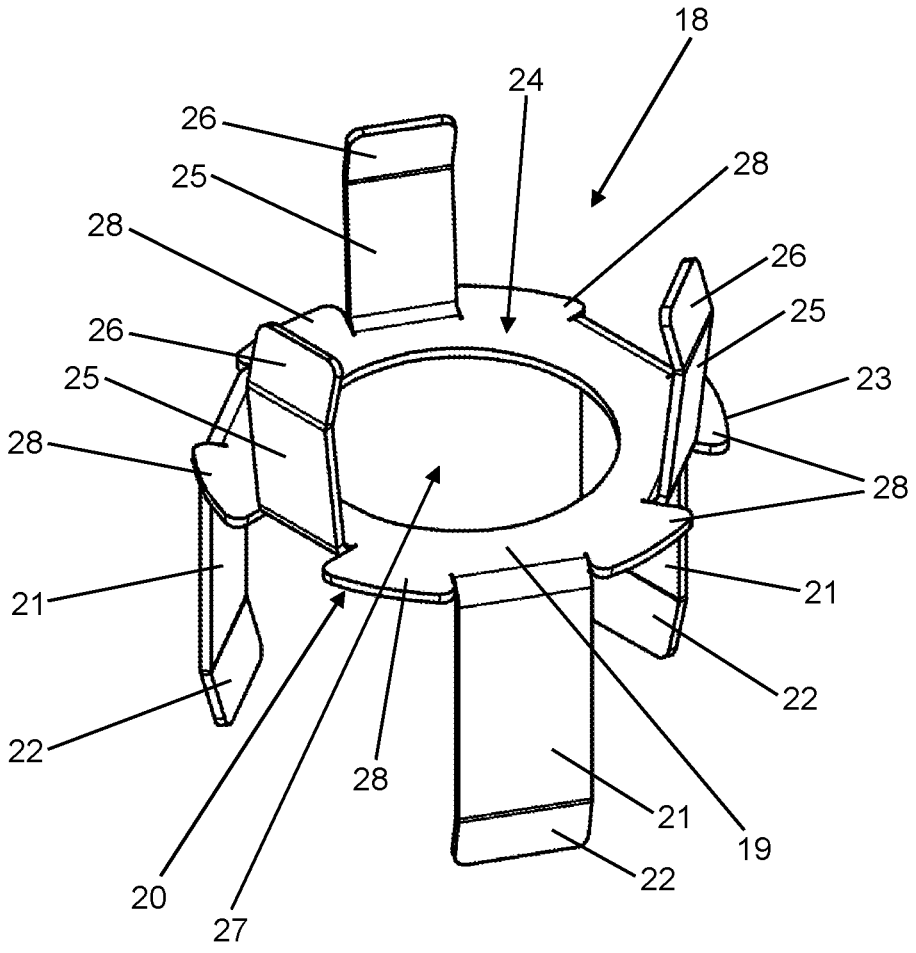
FIG. 3 is a perspective view of an anti-tilt device.
Figure 4:
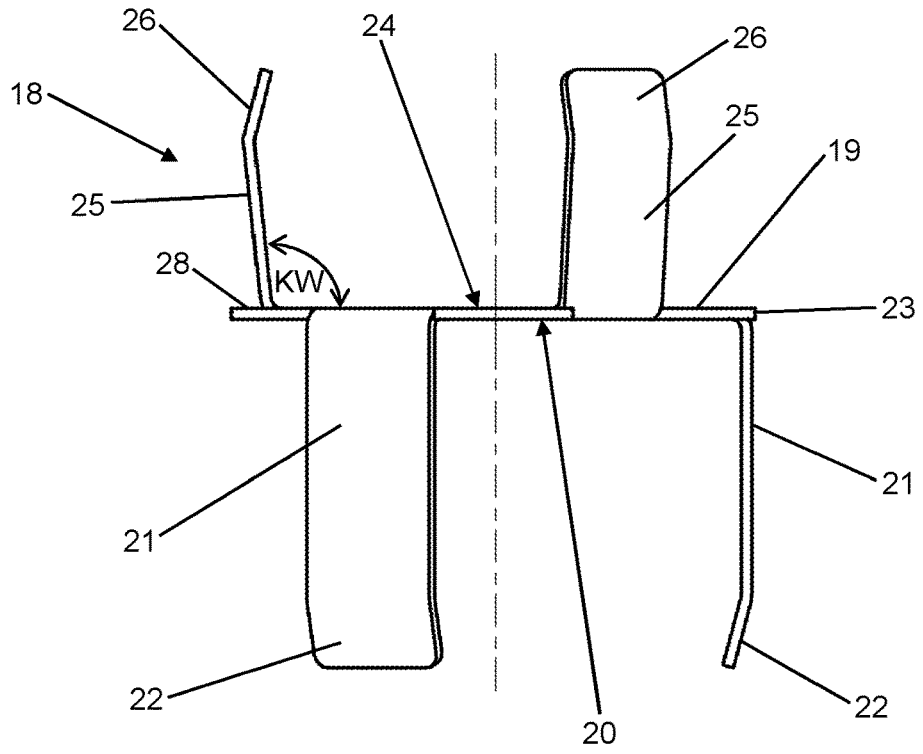
FIG. 4 is a front view of the anti-tilt device according to FIG. 3.
Figure 5:
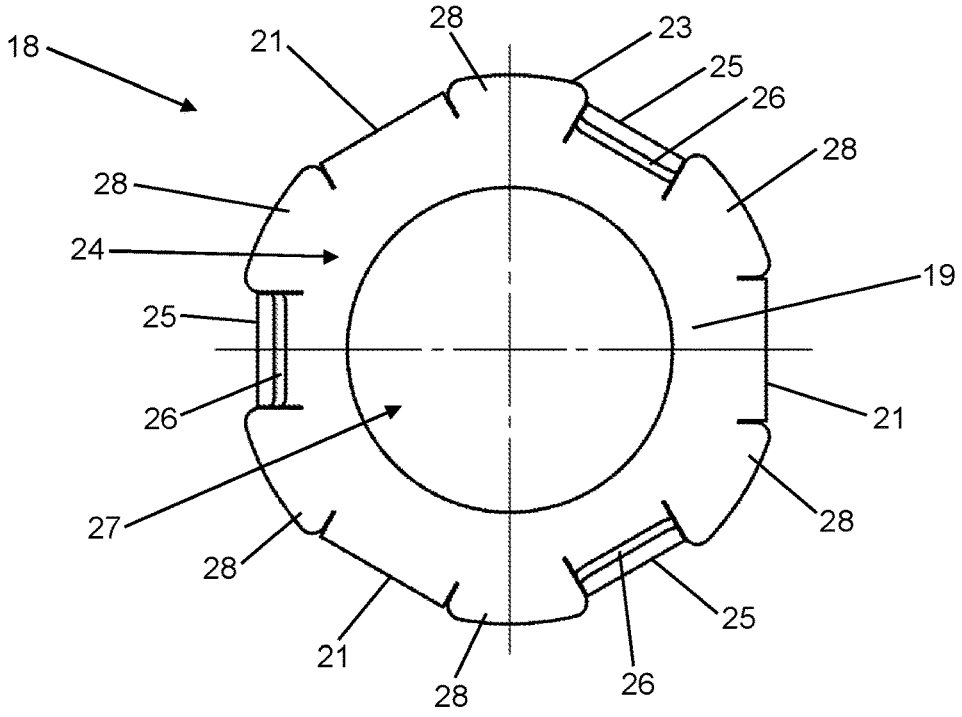
FIG. 5 is a top view of the anti-tilt device according to FIG. 3.

FIG. 3 shows a perspective view of an anti-tilt device 18 for a proposed apparatus 1, FIG. 4 shows a front view of the anti-tilt device according to FIG. 3, and FIG. 5 shows a top view of the anti-tilt device according to FIG. 3.

The anti-tilt device 18 shown comprises a substantially plate-shaped central plate 19 having a lower first central plate surface 20 which is not visible in this view, and having an upper second central plate surface 24 visible in this view. The central plate 19 has a centrally arranged central opening 27 which extends through the central plate 19.

The anti-tilt device 18 shown has multiple, in the specific example three, anti-tilt protrusions 21 projecting substantially perpendicularly from the first central plate surface 20 of the central plate 19. Each of the three anti-tilt protrusions 21, which are arranged in the manner of a spring on the central plate 19, has in each case a protrusion end 22 angled in the direction of the first central plate surface 20 (i.e., angled toward a central longitudinal axis of the anti-tilt device).

The anti-tilt device 18 has, moreover, multiple, in the specific example three, clamp elements 25 projecting from the second central plate surface 24 of the central plate 19 at a clamp angle KW (see FIG. 4). In the assembled state of the anti-tilt device 18, the clamp elements 25 are located in the conically formed through hole 16 of the apparatus 1. The clamp angle KW corresponds to the wall angle WW of the inside wall 17 of the conically tapering through hole 16, so that the anti-tilt device 18 is held stably and reliably in the through hole 16 (cf., e.g., FIG. 4 and FIG. 10).

Each of the three clamp elements 25, which are arranged in the manner of a spring on the central plate 19, has in each case an element end 26 angled in the direction of the second central plate surface 24 (i.e., angled toward a central axis of the central opening 27). As a result, the operation of guiding the clamp elements 25 into the through hole 16 of the apparatus 1 is facilitated.

In the case of the anti-tilt device 18 shown, both the anti-tilt protrusions 21 and the clamp elements 25 are uniformly distributed along a central plate outer contour 23 of the central plate 19. In the specific example, an anti-tilt protrusion 21, a clamp element 25 spaced apart therefrom and a further anti-tilt protrusion 21, again spaced apart therefrom, are always arranged alternately along the central plate outer contour 23. A respective locating region 28 is located between an anti-tilt protrusion 21 and a clamp element 25 in each case. The locating regions 28 of the central plate 19 protrude slightly radially outwardly with respect to the anti-tilt protrusions 21 and the clamp elements 25 in a central plate plane of the central plate 19 (see, e.g., FIGS. 4 and 5). The locating regions 28 serve, in the assembled state of the anti-tilt device 18, to contact the anti-tilt device 18 against the plate surface 4 of the apparatus 1 (see, e.g., FIG. 7).

Figure 6:
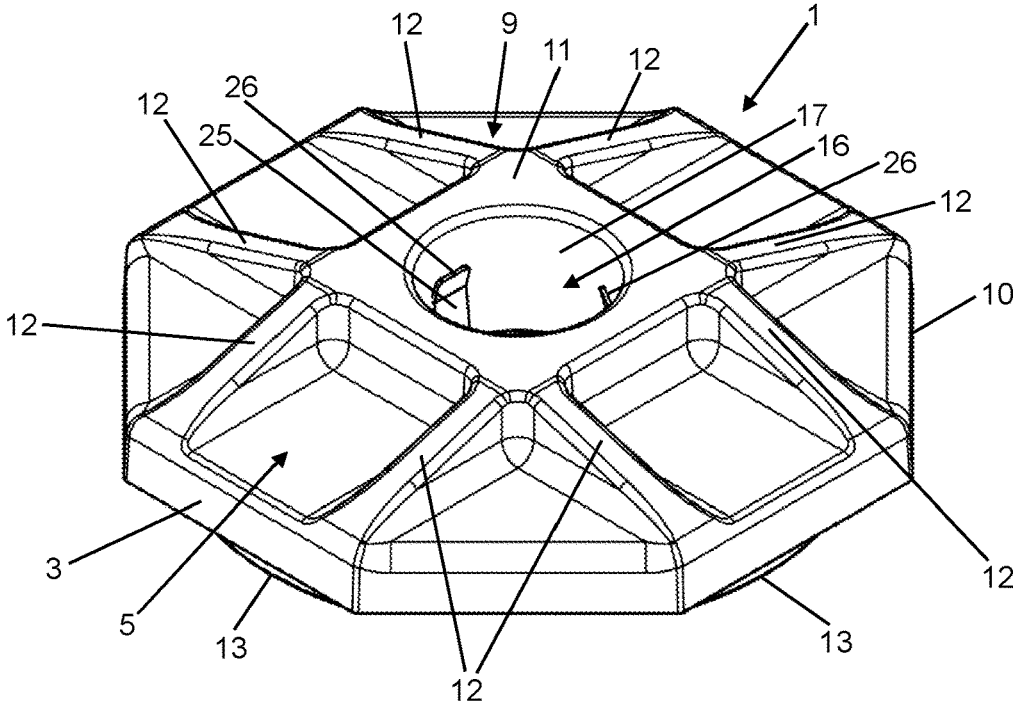
FIG. 6 is a perspective top view of the apparatus according to FIG. 1 with an anti-tilt device according to FIG. 3 arranged on the apparatus.
Figure 7:
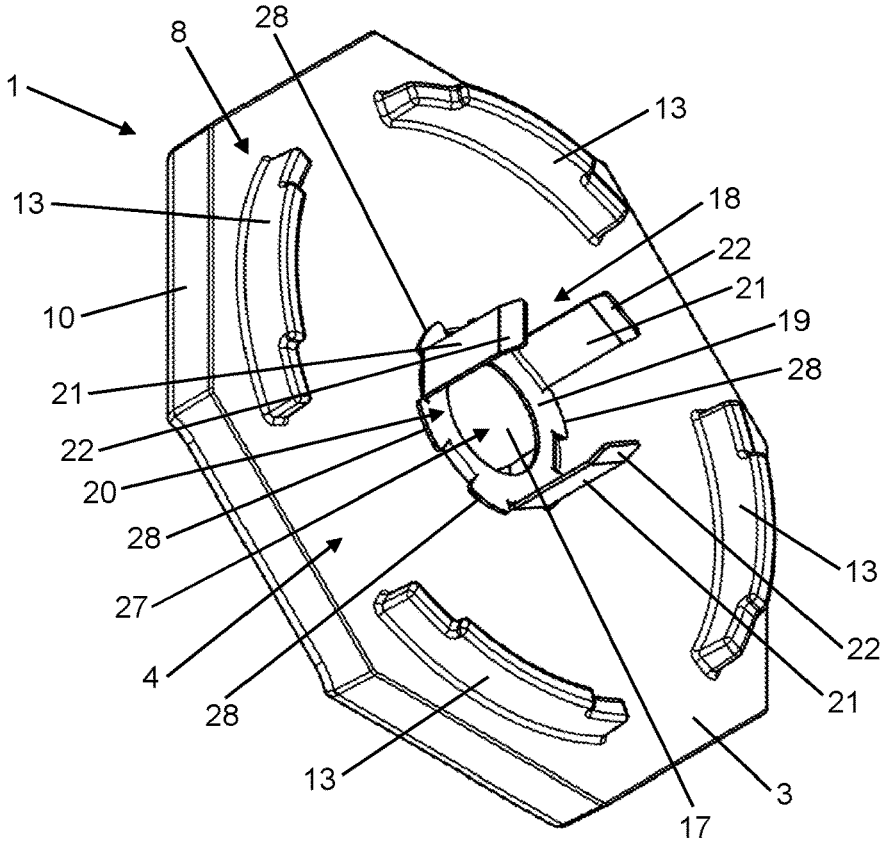
FIG. 7 is a perspective bottom view of the apparatus according to FIG. 6.

FIG. 6 shows a perspective top view of a proposed apparatus 1 with an anti-tilt device 18 arranged on the apparatus 1, wherein the anti-tilt device 18 is arranged protruding from the lower plate surface 4 on the apparatus 1. FIG. 7 shows a perspective bottom view of the apparatus 1 which is equipped with the anti-tilt device 18 according to FIG. 6.

The apparatus 1 shown in FIGS. 6 and 7 corresponds to the apparatus 1 according to FIGS. 1 and 2, and the anti-tilt device 18 corresponds to the anti-tilt device 18 according to FIGS. 3 to 5.

The anti-tilt device 18 is, in the shown assembled state of the anti-tilt device 18, partially arranged in the through hole 16 of the apparatus 1. In specific terms, the anti-tilt device 18, with its clamp elements 25, was guided into the through hole 16 until the locating regions 28 of the central plate 19 of the anti-tilt device 18 came to rest on the plate surface 4. The clamp elements 25 are located substantially completely within the through hole 16. In the shown assembled state of the anti-tilt device 18, the clamp elements 25 arranged in the manner of a spring on the central plate 19 press against the inside wall 17 of the through hole 16. In FIG. 7, the anti-tilt protrusions 21 projecting substantially perpendicularly from the first central plate surface 20 of the central plate 19 can be seen.

Figure 8A:
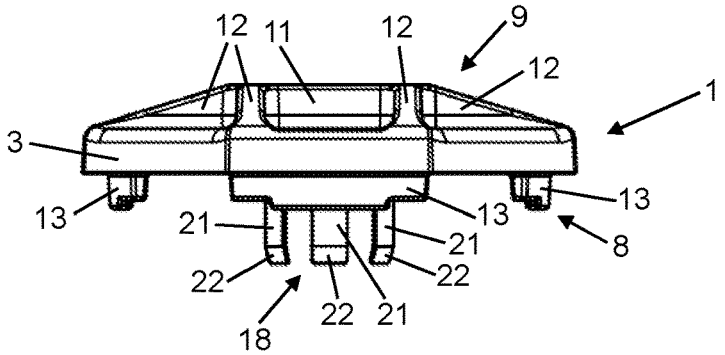
FIG. 8*a* is a front view of a proposed apparatus with an anti-tilt device arranged thereon.
Figure 8B:
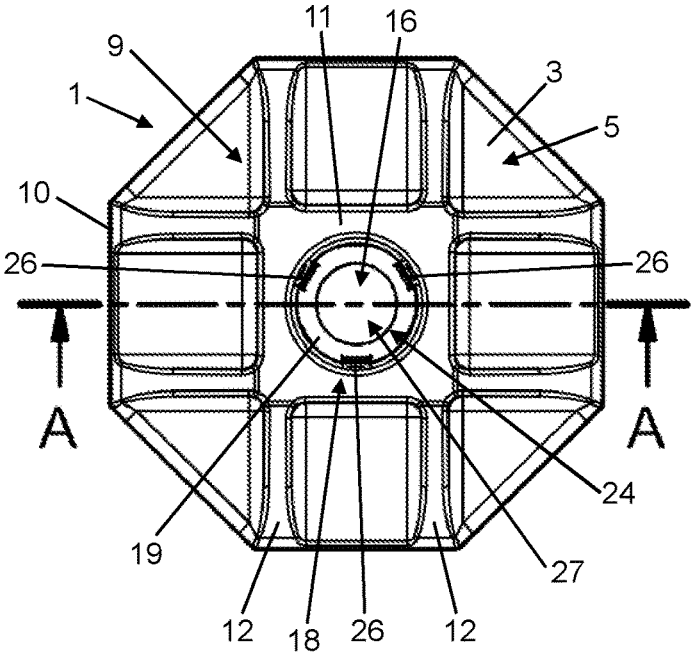
FIG. 8*b* is a top view of the apparatus according to FIG. 8*a*.
Figure 8C:
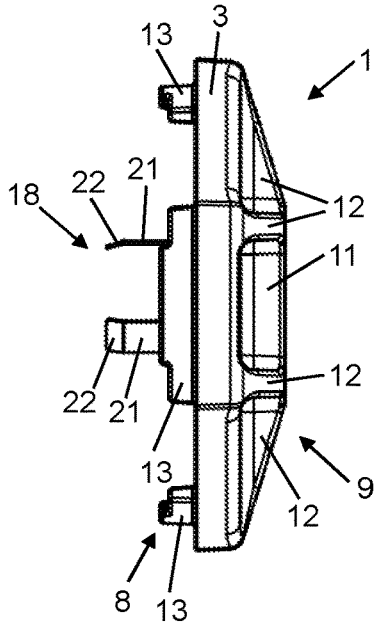
FIG. 8*c* is a side view of the apparatus according to FIG. 8*b*.
Figure 8D:
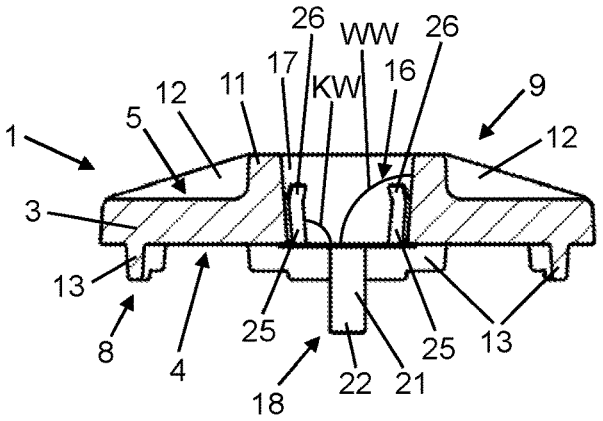
FIG. 8*d* is a sectional view along section line A-A in FIG. 8*b*.
Figure 8E:
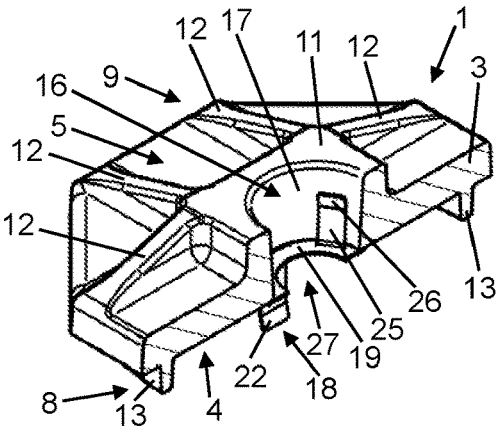
FIG. 8*e* is a perspective sectional view along section line A-A in FIG. 8*b*.

FIG. 8*a* shows a front view of a proposed apparatus 1 with an anti-tilt device 18 arranged thereon, FIG. 8*b* shows a top view of the apparatus 1 according to FIG. 8*a*, FIG. 8*c* shows a side view of the apparatus 1 according to FIG. 8*b*, FIG. 8*d* shows a sectional view along section line A-A in FIG. 8*b*, and FIG. 8*e* shows a perspective sectional view along section line A-A in FIG. 8*b*.

The apparatus 1 shown in FIGS. 8*a* to 8*e* corresponds to the apparatus 1 according to FIGS. 1 and 2, and the anti-tilt device 18 corresponds to the anti-tilt device 18 according to FIGS. 3 to 5.

The fact that the pressure distribution plate 3 is formed integral (more particularly, in one piece) with the support structure 9 and the collar sections 13 of the centering collar 8 can be seen in particular in FIGS. 8*d* and 8*e*, and it can be seen in FIG. 8*d* that the clamp angle KW of the clamp elements 25 corresponds to the wall angle WW of the inside wall 17 of the conically tapering through hole 16, so that the anti-tilt device 18 is held stably and reliably in the through hole 16.

Figure 9:
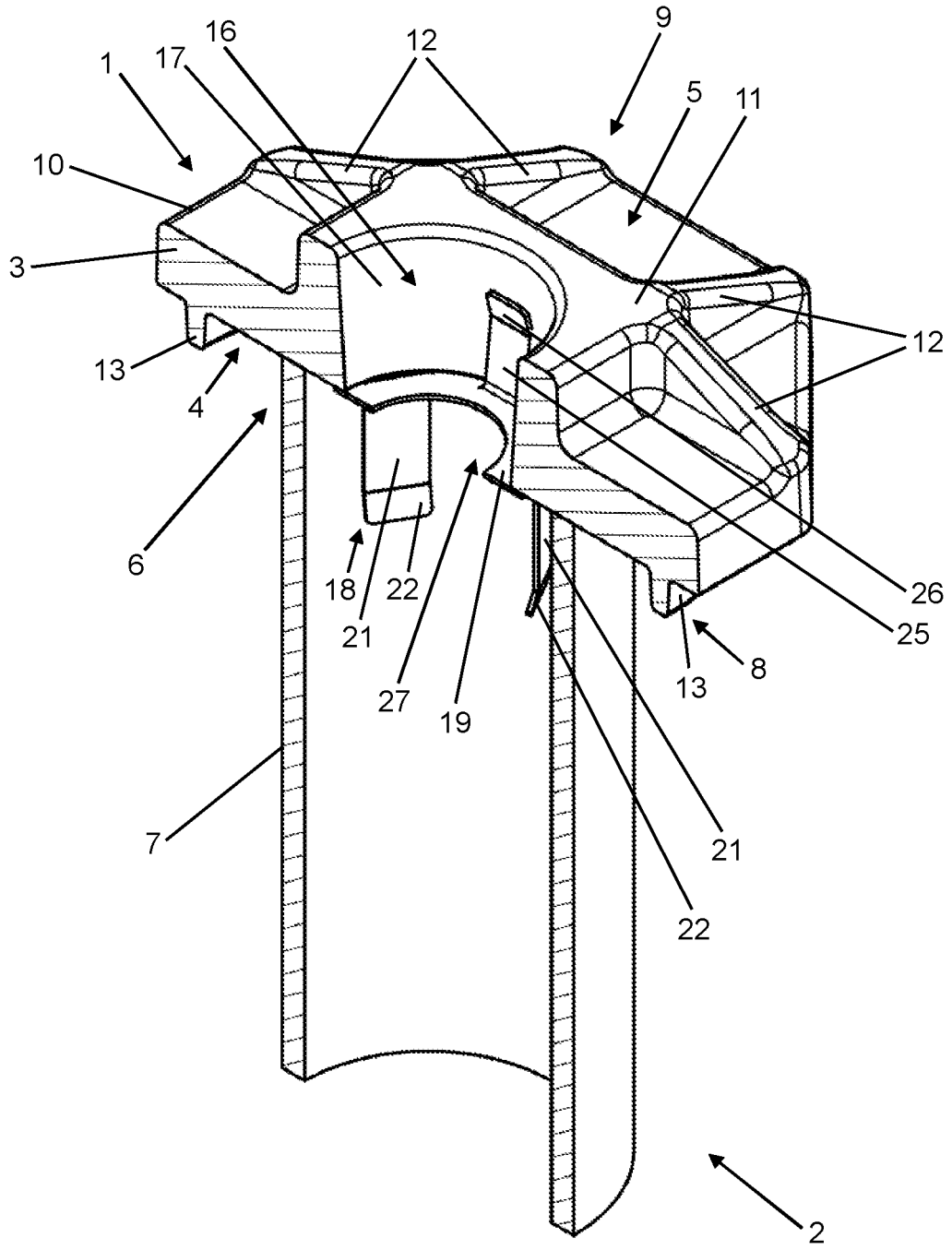
FIG. 9 is a perspective sectional view of a pile end of a tubular pile of a tubular pile foundation with an apparatus for ending the tubular pile foundation arranged thereon.
Figure 10:
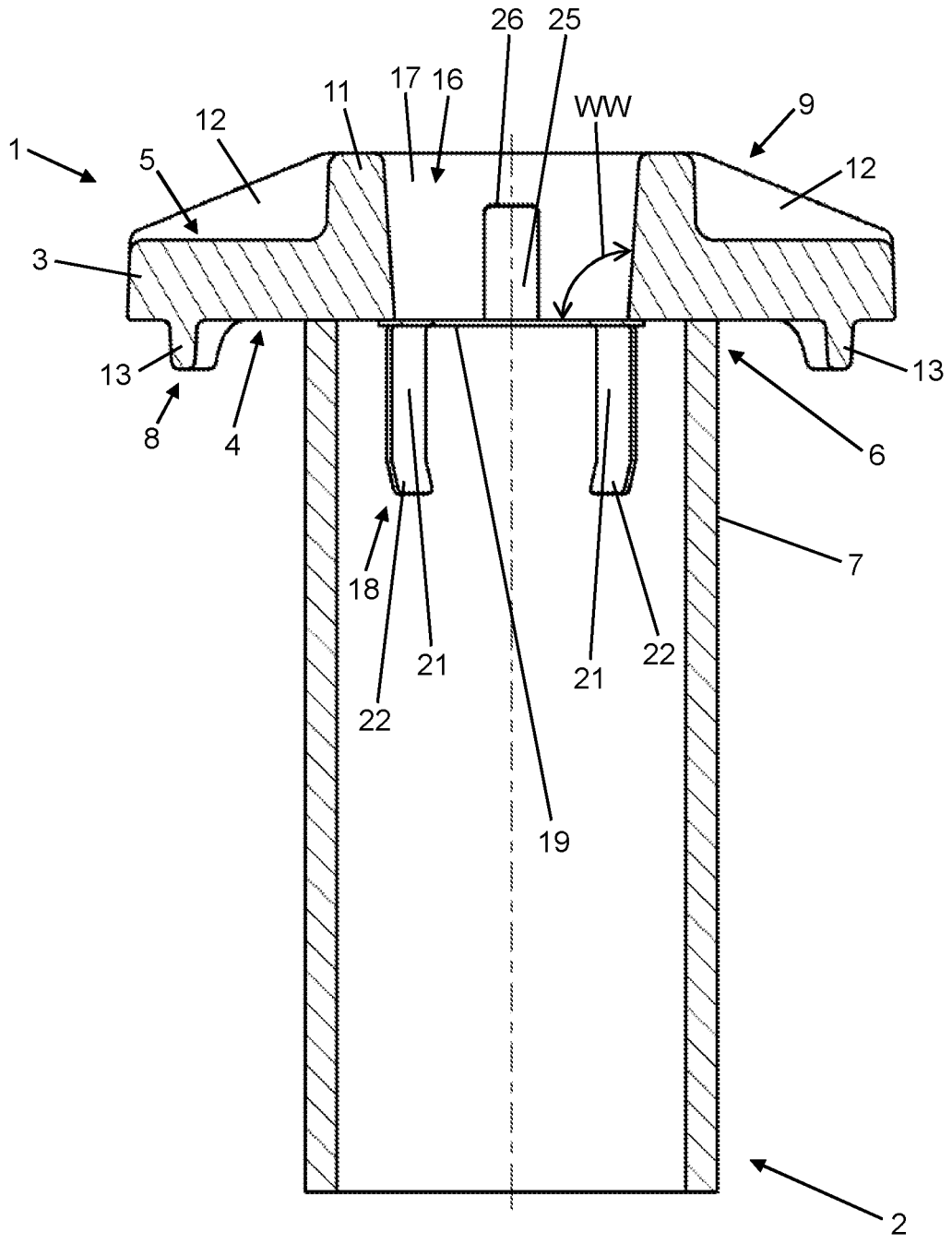
FIG. 10 is a sectional view of the pile end according to FIG. 9.

FIG. 9 shows a perspective sectional view of a pile end 6 of a tubular pile 7 of a tubular pile foundation 2 with an apparatus 1 for ending the tubular pile foundation 2 arranged thereon, and FIG. 10 shows a sectional view of the pile end 6 according to FIG. 9.

An apparatus 1 with an anti-tilt device 18 arranged on the apparatus 1 can be seen here, as illustrated in FIG. 6 and FIG. 7, and this apparatus 1 is fitted with the plate surface 4 of the pressure distribution plate 3 onto the pile end 6. The anti-tilt device 18 comprises multiple anti-tilt protrusions 21 which are uniformly distributed (evenly spaced apart) along a central plate outer contour 23 of the central plate 19 of the anti-tilt device 18 (see, e.g., FIG. 5) and which project substantially perpendicularly from the first central plate surface 20 of the central plate 19 (see, e.g., FIG. 7).

In the arrangement of the apparatus 1 on the pile end 6 shown, the anti-tilt device 18 is partially arranged in the interior of the hollow tubular pile 7. To this end, the apparatus 1 with the clamp elements 25 was first fitted onto the pile end 6, until the plate surface 4 of the pressure distribution plate 3 came to rest on the pile end 6. The anti-tilt protrusions 21 are located in the interior of the hollow tubular pile 7 and the pile end 6 comes to lie within the centering collar 8.

The centering collar 8 arranged on the plate surface 4 of the pressure distribution plate 3 and projecting from the plate surface 4, and the anti-tilt protrusions 21 act as guiding and centering aids, so that it can be ensured that the apparatus 1 is fitted substantially centrally onto the pile end 6. In particular, the anti-tilt device 18 or the clamp elements 25 thereof serve to prevent the apparatus 1 from slipping laterally from the pile end 6 and tipping downwards from the pile end 6.

The through hole 16 of the apparatus 1 aligns with the interior of the hollow tubular pile 7, so that in particular in the case of a tubular pile foundation 2 pressed with concrete, concrete or concrete emulsion as well as corresponding reinforcing elements can be easily introduced into the interior of the pile.

Figure 11:
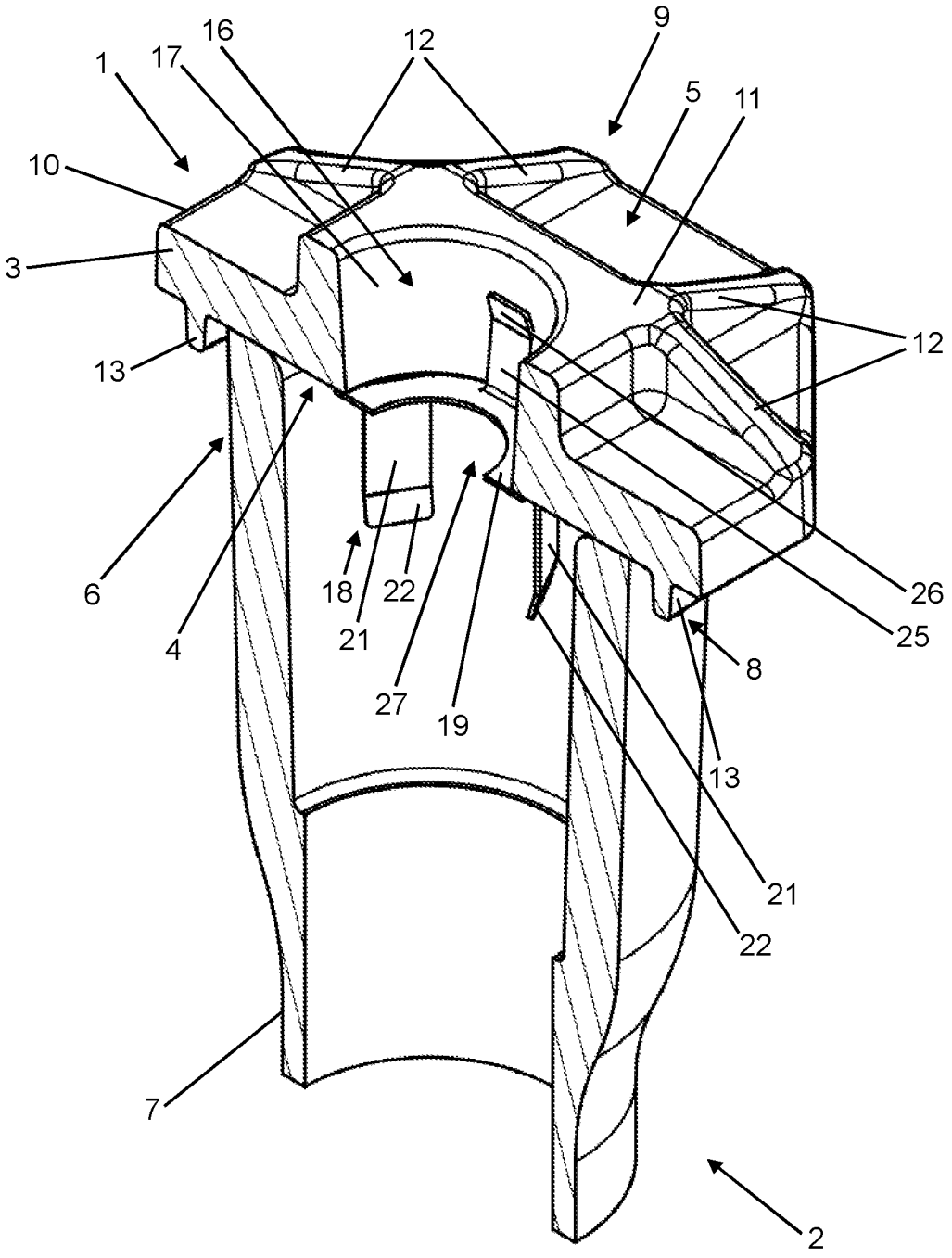
FIG. 11 is a perspective sectional view of a pile end of a tubular pile of a tubular pile foundation with an apparatus for ending the tubular pile foundation arranged thereon.
Figure 12:
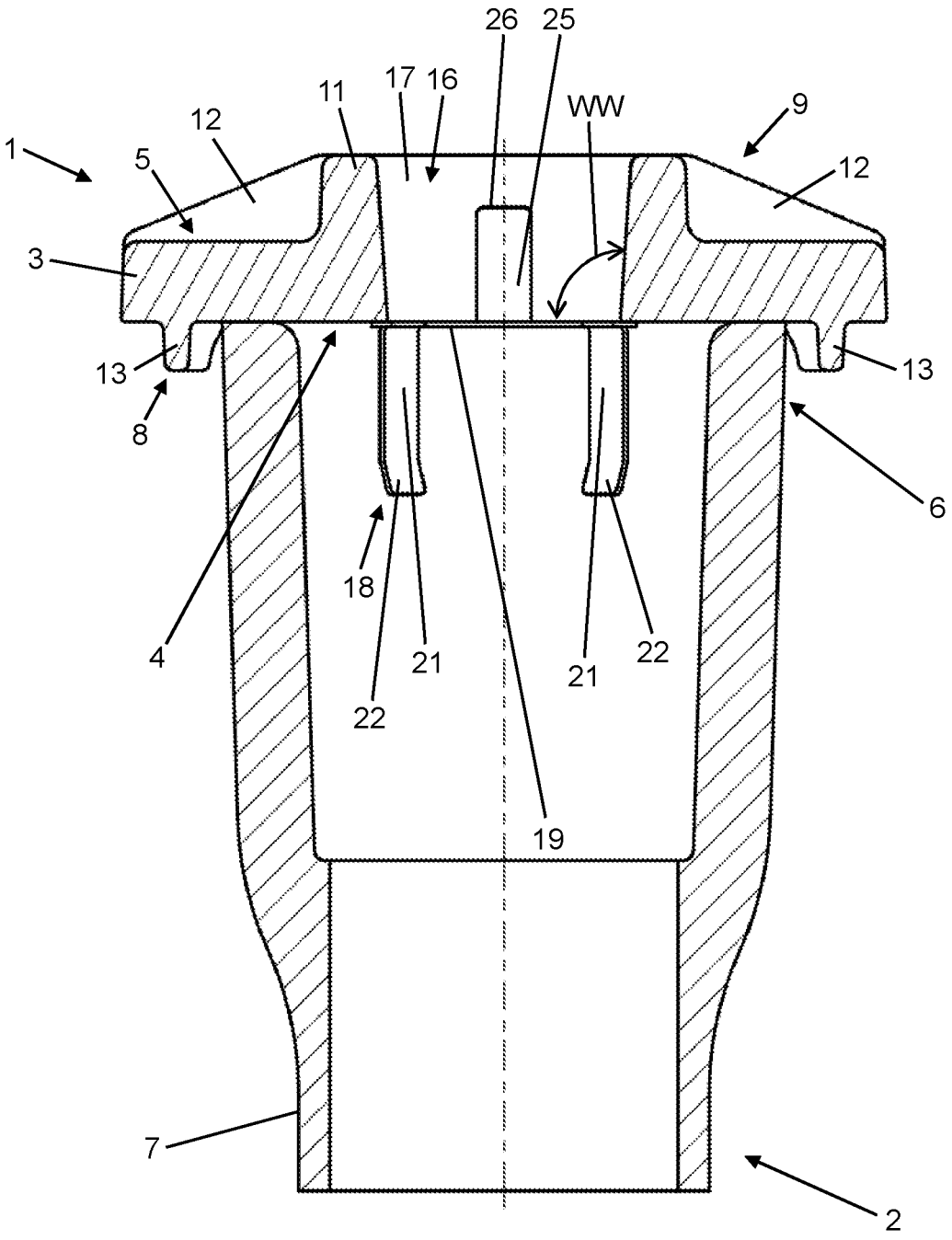
FIG. 12 is a sectional view of the pile end according to FIG. 11.

FIG. 11 shows a perspective sectional view of a pile end 6 of a tubular pile 7 of a tubular pile foundation 2, which is formed in the manner of a socket, with an apparatus 1 for ending the tubular pile foundation 2 arranged thereon, and FIG. 12 shows a sectional view of the pile end 6 according to FIG. 11.

The representations shown correspond to the representations in FIGS. 9 and 10 with the difference that the apparatus 1 is fitted onto a pile end 6 here, which is formed in the manner of a socket.

LIST OF REFERENCE NUMBERS

1 Apparatus for ending a tubular pile foundation
2 Tubular pile foundation
3 Pressure distribution plate
4 Plate surface
5 Contact surface
6 Pile end
7 Tubular pile
8 Centering collar
9 Support structure
10 Outer contour
11 Support block
12 Support rib
13 Collar section
14 Stop region
15 Section end
16 Through hole
17 Inside wall
18 Anti-tilt device
19 Central plate
20 First central plate surface
21 Anti-tilt protrusion
22 Protrusion end
23 Central plate outer contour
24 Second central plate surface
25 Clamp element
26 Element end
27 Central opening
28 Locating region
K Circular path
AL Section longitudinal extent
AH Stop height
WW Wall angle
KW Clamp angle

The invention claimed is:

1. An apparatus for ending a tubular pile foundation, the apparatus comprising:

a pressure distribution plate having a substantially flat plate surface and a contact surface opposite the plate surface for supporting a structure to be erected on the tubular pile foundation, the pressure distribution plate to be fitted with the plate surface facing downward onto a pile end of a tubular pile of the tubular pile foundation, a centering collar for centering the apparatus on the pile end arranged on the plate surface of the pressure distribution plate, and a support structure configured to reinforce the pressure distribution plate arranged on the contact surface of the pressure distribution plate, the support structure comprising a support block, wherein the centering collar comprises a collar section having a circular arc form, the collar section having (i) a stop region along a section of a longitudinal extent of the collar section and (ii) end sections on opposite ends of the stop region, each of the end sections of the collar section having a reduced height as compared to a height of the stop region.

2. The apparatus according to claim 1, wherein the pressure distribution plate has a polygonal outer contour.

3. The apparatus according to claim 2, wherein the pressure distribution plate has an octagonal outer contour.

4. The apparatus according to claim 1, wherein the support block is arranged centrally on the contact surface of the pressure distribution plate.

5. The apparatus according to claim 1, wherein the support structure comprises a support rib.

6. The apparatus according to claim 5, wherein the support rib is arranged on the support block or adjoins the support block, and is formed integral with the support block.

7. The apparatus according to claim 5, wherein the support rib is a vertical wall extending between the support block and an outer contour of the pressure distribution plate.

8. The apparatus according to claim 1, wherein the collar section of the centering collar is one of a plurality of collar sections formed as circular arcs uniformly distributed along a common circular path.

9. The apparatus according to claim 1, wherein the collar section is arranged opposite the support structure arranged on the contact surface.

10. The apparatus according to claim 1, wherein the pressure distribution plate is formed of cast iron.

11. The apparatus according to claim 1, wherein the pressure distribution plate and the support structure have a through hole having a diameter larger than 50 mm extending therethrough.

12. The apparatus according to claim 11, wherein the through hole has a conical shape tapering radially inwardly toward the plate surface, wherein an inside wall of the through hole has a wall angle relative to the plate surface in a range of 91° to 110°.

13. The apparatus according to claim 11, wherein the through hole has a diameter larger than 70 mm.

14. The apparatus according to claim 1, further comprising an anti-tilt device protruding from the plate surface and arranged on the pressure distribution plate.

15. The apparatus according to claim 14, wherein the anti-tilt device is partially arranged in a through hole extending through the pressure distribution plate and the support structure.

16. The apparatus according to claim 14, wherein the anti-tilt device comprises a central plate and an anti-tilt protrusion projecting from a first central plate surface of the central plate.

17. The apparatus according to claim 16, wherein the anti-tilt protrusion of the anti-tilt device is one of a plurality of anti-tilt protrusions uniformly distributed along a central plate outer contour of the central plate.

18. The apparatus according to claim 16, wherein the anti-tilt protrusion is configured as a spring on the central plate.

19. The apparatus according to claim 16, wherein the anti-tilt device further comprises a clamp element projecting from a second central plate surface of the central plate opposite the first central plate surface at a clamp angle in a range of 90° to 110.

20. The apparatus according to claim 19, wherein the clamp element of the anti-tilt device is one of a plurality of clamp elements uniformly distributed along a central plate outer contour of the central plate.

21. The apparatus according to claim 19, wherein the clamp element is configured as a spring on the central plate.

22. The apparatus according to claim 19, wherein the clamp element is arranged completely within a through hole extending through the pressure distribution plate and the support structure, and is in contact with an inside wall of the through hole.

23. The apparatus according to claim 19, wherein the clamp element has an element end angled toward a central longitudinal axis of the anti-tilt device.

24. The apparatus according to claim 16, wherein the central plate has a central opening.

25. The apparatus according to claim 24, wherein the central opening is centrally arranged.

26. The apparatus according to claim 16, wherein the anti-tilt protrusion has a protrusion end angled toward a central longitudinal axis of the anti-tilt device.

27. The apparatus according to claim 1, wherein the stop region has a constant stop height.

* * * * *